US007790250B2

(12) United States Patent
Baker et al.

(10) Patent No.: US 7,790,250 B2
(45) **Date of Patent: *Sep. 7, 2010**

(54) INKJET RECORDING MEDIUM

(75) Inventors: Julie Baker, Leavesden (GB); Joanne Hunt, Abbots Langley (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/631,236

(22) Filed: Jul. 31, 2003

(65) Prior Publication Data

US 2004/0027440 A1 Feb. 12, 2004

(30) Foreign Application Priority Data

Aug. 9, 2002 (GB) ..... 0218505.6

(51) Int. Cl.
*B41M 5/50* (2006.01)

(52) U.S. Cl. ..... 428/32.24; 428/32.31

(58) Field of Classification Search ..... 428/32.26, 428/32.31, 32.32

See application file for complete search history.

(56) References Cited

U.S. PATENT DOCUMENTS

| | | | | |
|---|---|---|---|---|
| 6,245,421 | B1 | 6/2001 | Aurenty et al. | |
| 6,291,127 | B1 | 9/2001 | Dagan et al. | |
| 6,299,302 | B1 * | 10/2001 | DeBoer et al. | 428/32.24 |
| 6,929,824 | B2 * | 8/2005 | Baker | 427/244 |
| 2001/0021726 | A1 | 9/2001 | Brown | |
| 2002/0012786 | A1 * | 1/2002 | Iwasa et al. | 428/317.9 |
| 2002/0045035 | A1 | 4/2002 | Nojima et al. | |
| 2004/0028817 | A1 * | 2/2004 | Hunt et al. | 427/337 |
| 2004/0071901 | A1 * | 4/2004 | Baker et al. | 428/32.1 |
| 2004/0229966 | A1 * | 11/2004 | Dontula et al. | 521/50 |
| 2005/0276935 | A1 * | 12/2005 | Toda et al. | 428/32.34 |
| 2006/0099355 | A1 * | 5/2006 | Baker | 428/32.1 |
| 2006/0270745 | A1 * | 11/2006 | Hunt et al. | 521/50.5 |

FOREIGN PATENT DOCUMENTS

| | | | |
|---|---|---|---|
| EP | 0747230 | A2 | 12/1996 |
| EP | 0830952 | A2 | 3/1998 |
| EP | 0896883 | A1 | 2/1999 |
| EP | 1002659 | A2 | 5/2000 |
| EP | 1060901 | A2 | 12/2000 |
| JP | 61035278 | | 2/1986 |
| JP | 63286392 | | 11/1988 |
| JP | 07323657 | | 12/1995 |
| JP | 08104055 | | 4/1996 |

(Continued)

OTHER PUBLICATIONS

Concise Chemical and Technical Dictionary, Fourth Enlarged Addition, edited by H. Bennett, F.A.I.C., published by the Chemical Publishing Com., Inc. of New York in 1986, p. 212.*

(Continued)

*Primary Examiner*—Bruce H Hess
(74) *Attorney, Agent, or Firm*—Chris P. KonKol; Arthur E. Kluegel; Andrew J. Anderson

(57) ABSTRACT

The invention provides an inkjet recording medium, comprising a support and an ink receiving layer supported on the support. The ink receiving layer comprising a porous hydrophilic polymer.

13 Claims, 2 Drawing Sheets

FOREIGN PATENT DOCUMENTS

| | | |
|---|---|---|
| JP | 08318672 | 12/1996 |
| JP | 09001923 | 1/1997 |
| JP | 09020069 | 1/1997 |
| JP | 09029926 | 2/1997 |
| JP | 11010762 | 1/1999 |
| JP | 11198525 | 7/1999 |
| JP | 11277895 | 10/1999 |
| JP | 2000085241 | 3/2000 |
| JP | 2001039024 | 2/2001 |

OTHER PUBLICATIONS

XP-002264704 Derwent, Dec. 21, 1999, JP.
JP Abstract 2001-162924, Jun. 19, 2001.

* cited by examiner

20μm

20μm

INKJET RECORDING MEDIUM

FIELD OF THE INVENTION

The present invention relates to an inkjet recording medium (receiver).

BACKGROUND OF THE INVENTION

Inkjet printing is a process in which a stream of ink, preferably in the form of droplets, is ejected at high speed from nozzles against a medium so as to create an image.

Media used for inkjet recording need to be dimensionally stable, absorptive of ink, capable of providing a fixed image and compatible with the imaging materials and hardware.

Most commercial photo-quality inkjet media can be classified in one of two categories according to whether the principal component material forms a layer that is porous or non-porous in nature. Inkjet media having a porous layer are typically formed of inorganic materials with a polymeric binder. When ink is applied to the medium it is absorbed into the porous layer by capillary action. The ink is absorbed very quickly, but the open nature of the porous layer can contribute to instability of printed images, particularly when the images are exposed to environmental gases such as ozone.

Inkjet media having a non-porous layer are typically formed of one or more polymeric layers that swell and absorb applied ink. However, due to limitations of the swelling mechanism, this type of media is slow to absorb the ink, but once dry, printed images are often stable when subjected to light and ozone.

Japanese Patent application number 2001162924 in the name of Dainippon Ink and Chemicals, discloses an ink receiving layer comprising a porous receiver in which the pores are filled with a hydrophilic polymer. The pores are formed by irradiation of the receiver.

United States Patent application number US2001/0021726 in the name of James F Brown relates to the use of a porous resinous material for retaining biological samples.

An inkjet recording medium is required that addresses the problems identified above.

SUMMARY OF THE INVENTION

According to the present invention, there is provided an inkjet recording medium, comprising a support and an ink receiving layer supported on the support. The ink-receiving layer comprises a porous hydrophilic polymer. Any suitable swellable polymer may be used as the hydrophilic polymer in the ink-receiving layer.

Preferably, the porous hydrophilic polymer includes polyvinyl alcohol.

Any suitable material may be used as the support. Possible examples include resin-coated paper and film base i.e. polyethylene terephthalate (PET).

ADVANTAGEOUS EFFECT OF THE INVENTION

The present invention provides an inkjet media having a porous hydrophilic polymer layer. This enables faster absorption of the ink to be achieved compared to a pure non-porous hydrophilic polymer layer, whilst still maintaining the image stability that is achieved from a non-porous medium. When compared to a conventional porous medium, the medium of the present invention shows significant improvements in image stability.

As will be explained below, one possible method suitable for the manufacture of media according to the present invention, involves the use of blowing agents. By using blowing agents in conjunction with a hydrophilic polymer e.g. a swellable hydrophilic polymer, a swellable porous medium is produced. This results in improved absorption of the ink and dye within the ink. However, instead of the dye being held in pores which are located in between particles (which is the case for traditional porous media) the dye is located within the polymer, thereby improving image stability.

BRIEF DESCRIPTION OF THE DRAWINGS

Examples of the present invention will now be described in detail with reference to the accompanying drawings, in which.

DETAILED DESCRIPTION OF THE INVENTION

Figure 1:
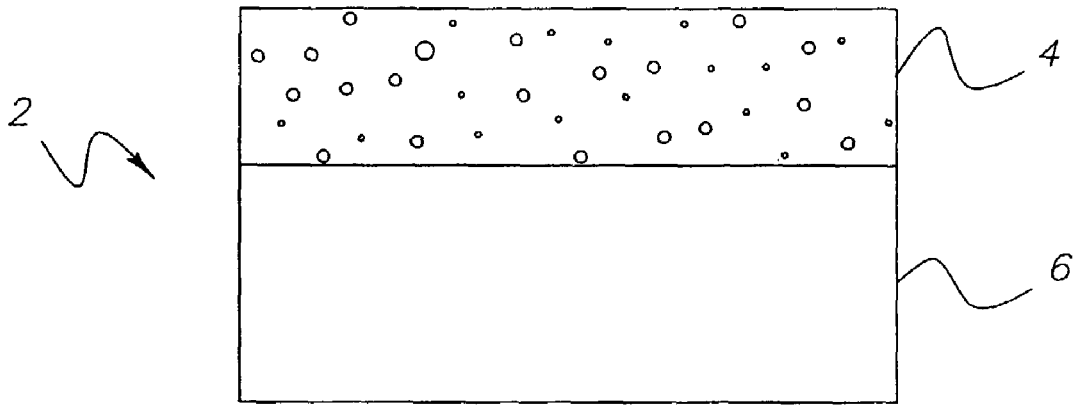
FIG. 1 is a schematic representation of a section through an inkjet medium according to the present invention.

FIG. 1 is a schematic representation of a section through an inkjet medium according to the present invention. The medium 2 comprises a support layer 6, such as resin-coated paper, PET film base, acetate, printing plate or any other suitable support and a polymeric layer 4 of porous hydrophilic polymer supported thereon.

In most cases the hydrophilic polymer will be swellable. However, it is possible that an amount of crosslinker such as borax, tetraethyl orthosilicate, 2,3-dihydroxy-1,4-dioxane (DHD) or any other suitable crosslinker may be added to the polymer to provide an amount of crosslinking to the polymeric layer 4. Any suitable hydrophilic polymer may be used in the porous hydrophilic polymer layer including, amongst others, polyvinyl alcohol (PVA), polyethylene oxide (PEO), polyvinyl pyrrolidone (PVP) and gelatin.

Figure 2:
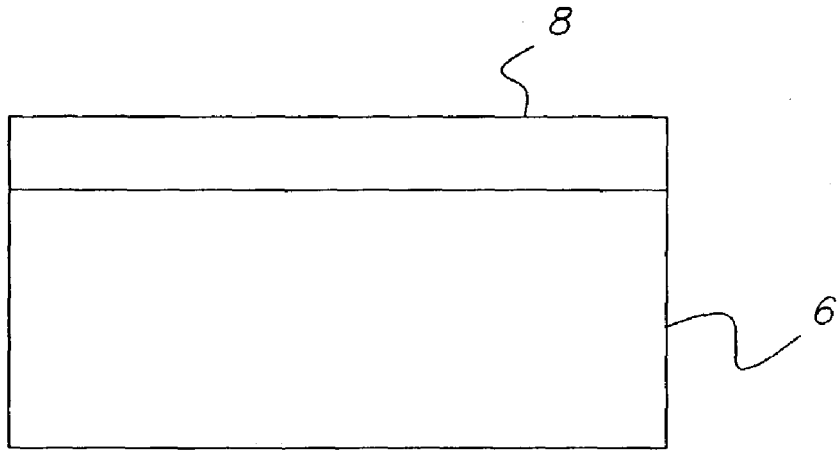
FIG. 2 is a schematic representation of a section through a conventional non-porous inkjet medium.

FIG. 2 shows a schematic representation of a section through a conventional non-porous inkjet medium. In this case a non-porous polymeric layer 8 is supported on the support layer 6.

A surfactant such as Olin 10G may also be added to the hydrophilic polymer used in the porous hydrophilic polymeric layer 6 and serves as a coating aid. Examples of other suitable surfactants include Lodyne S100, Zonyl FSN or any other flouro-surfactant.

One possible method for making the material relies on the coating of a support with a solution comprising a hydrophilic polymer and a blowing agent, and optionally a surfactant. Such a method is described in detail in co-pending Patent Application GB 0218505.6, filed Aug. 8, 2002, entitled "A Method of Making a Material."

In one example, three layers of solution of a polymer are coated simultaneously onto a support. It is possible that the proportion by weight of blowing agent to polymer in the different layers varies. In any one or more of the layers the proportion by weight of blowing agent to polymer may be up to about 200%, although typically it would be in an amount from about 10% to about 60%, preferably about 30% to about 50%. The proportion by weight of surfactant, where present, to solution in the different layers may also vary. Typically, it would be in an amount from about 0.01% to about 2.0%, preferably, about 0.01% to about 1.0%. In the case where any number of layer(s) of solution of polymer are coated, the proportions by weight of blowing agent to polymer and surfactant, where present, to solution may have values in the same ranges.

Figure 3:
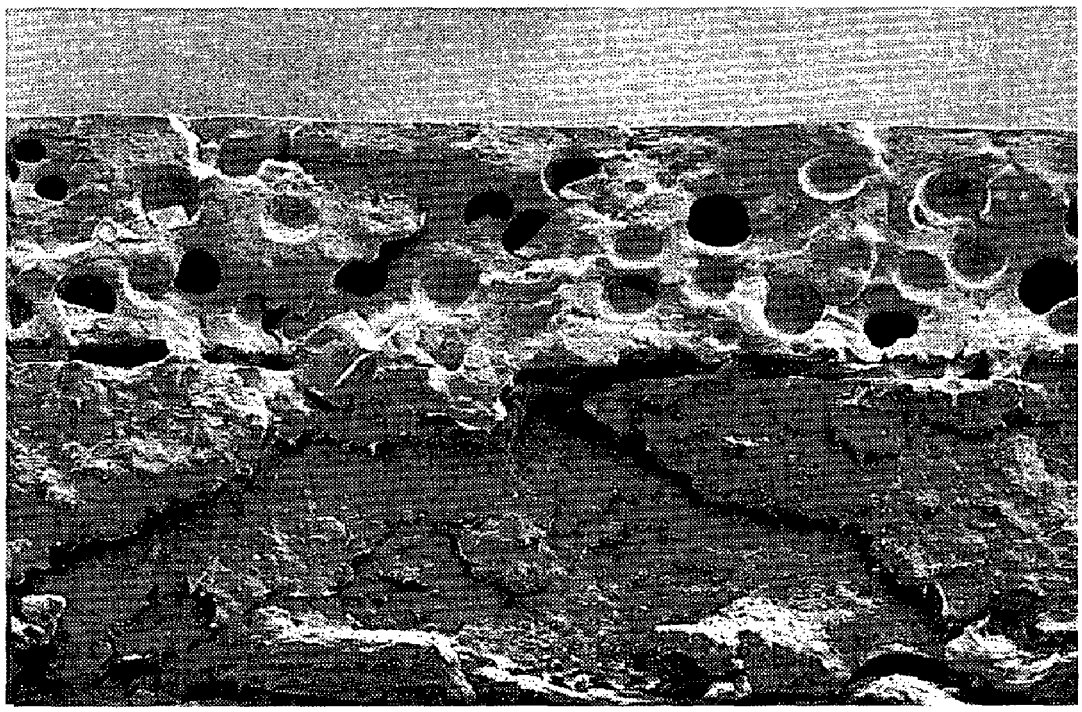
FIG. 3 is a scanning electron micrograph through an inkjet medium according to the present invention; and, FIG. 4 is a scanning electron micrograph through a conventional non-porous inkjet medium.
Figure 4:
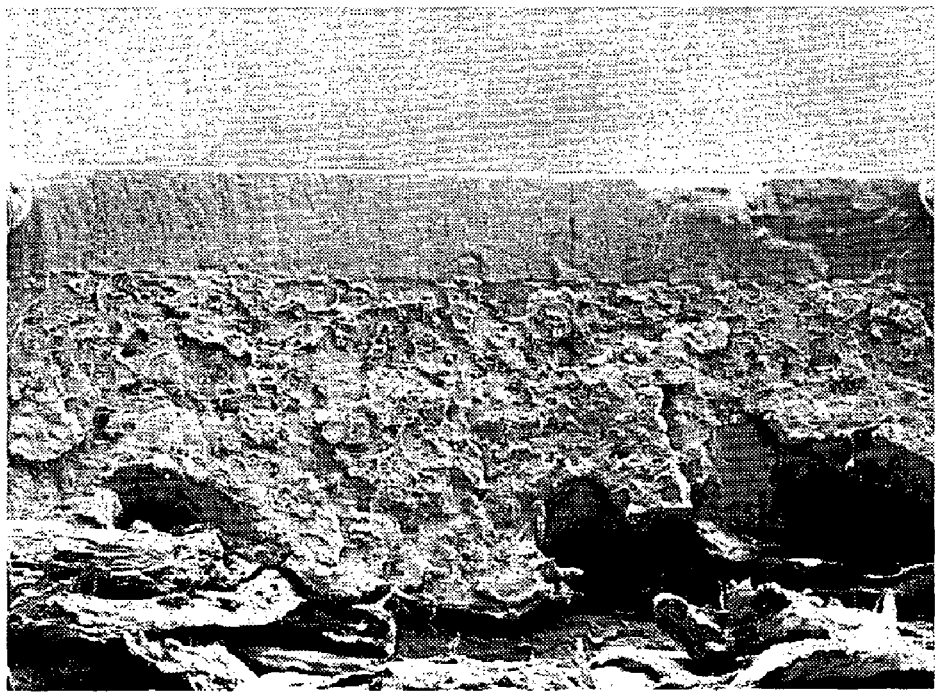

FIGS. 3 and 4 show scanning electron micrographs of a section through an inkjet receiver according to the present invention and a conventional non-porous polymer inkjet receiver, respectively. As shown schematically in FIGS. 1 and 2 bubbles are clearly visible in the polymer layer in FIG. 3.

The invention is illustrated by the following example.

Example

An inkjet medium was prepared as follows:

Three layers of polymer were coated simultaneously by a bead-coating machine using a conventional slide hopper onto a support consisting of a resin-coated paper. Each polymer layer functions as an ink-receiving layer when the medium is used for inkjet printing. In this example, each ink-receiving layer comprises polyvinyl alcohol (PVA), blowing agents (a total of 50% by weight compared to the mass of PVA per unit area) and an amount of surfactant.

The ink-receiving layer nearest the resin-coated paper support consisted of 6.1 g/m$^2$ of PVA, 1.72 g/m$^2$ of sodium nitrite, 1.33 g/m$^2$ of ammonium chloride and 0.212 g/m$^2$ of Olin 10G surfactant. The middle ink-receiving layer consisted of 6.8 g/m$^2$ of PVA, 1.92 g/m$^2$ of sodium nitrite, 1.48 g/m$^2$ of ammonium chloride and 0.424 g/m$^2$ of Olin 10G surfactant. The top ink-receiving layer consisted of 7.5 g/m$^2$ of PVA, 2.11 g/m$^2$ of sodium nitrite, 1.64 g/m$^2$ of ammonium chloride and 0.636 g/m$^2$ of Olin 10G surfactant.

For comparison, a control coating was also prepared at the same time where the layers were identical to those described above, except the blowing agents (sodium nitrite and ammonium chloride) were omitted.

To initiate the blowing process, the dryers inside the coating track were set to 90° C. through which the coated supports (used in the preparation of the medium according to the present invention and the control) were passed. As shown schematically in FIG. 1, the blowing agents have reacted due to the heat in the dryers causing voids to form and resulting in a foamed polymeric layer. This can be compared to the control coating, shown schematically in FIG. 2, where no voids can be seen.

Drytime and image stability were then compared for these two coatings. As an additional comparison, data for a commercially available porous medium (Epson Photo Glossy Paper) is also shown.

Drytime was evaluated by measuring the density of ink transferred to a piece of plain paper sandwiched to a printed image immediately after printing. The faster the sample dries the lower the ink density on the plain paper.

The following Printer set-up was used:

Printer:

Epson Stylus Photo 870

Printer Settings:

Print quality—photo 1440 dpi

Premium Glossy Photo Paper

The results in table 1 show the density of ink transferred during the drytime test.

TABLE 1

Density of ink transferred during drytime test.

| Coating | Density of Ink Transferred |
|---|---|
| Foamed Polymer Medium | 0.55 |
| PVA Control Coating | 0.78 |
| Epson Glossy Photo Paper | 0.02 |

The data in table 1 show that the foamed polymer medium transfers less ink during the drytime test than the PVA control coating does, which indicates that the coating of this invention absorbs the ink quicker. As expected, the commercially available porous medium, Epson Glossy Photo Paper transfers almost no ink at all due to its porous nature.

The light stability of the various media were assessed by printing an image, measuring the densities of the various colours (choosing a patch that has the density closest to 1.0) and then subjecting it to high intensity daylight (HID, 50 KLux) for a period of 7 days. The same colour patches were then measured again at the end of the 7 day period and the loss of density calculated.

The light stability results are shown in table 2.

TABLE 2

Light stability data

| Ctg | | Cyan | Magenta | Black | Green | Blue |
|---|---|---|---|---|---|---|
| Foamed | Fresh | 0.846 | 1.296 | 1.020 | 1.066 | 1.152 |
| Polymer | Faded | 0.822 | 1.027 | 1.005 | 1.061 | 1.103 |
| Medium | Delta | −2.8% | −20.8% | −1.5% | −0.5% | −4.3% |
| PVA | Fresh | 1.102 | 0.920 | 1.289 | 1.049 | 0.940 |
| Control | Faded | 1.089 | 0.772 | 1.257 | 1.048 | 0.906 |
| | Delta | −1.2% | −16.1% | −2.5% | −0.1% | −3.6% |
| Epson | Fresh | 0.836 | 1.377 | 1.115 | 0.900 | 1.405 |
| Glossy | Faded | 0.766 | 0.962 | 0.978 | 0.816 | 1.225 |
| Photo | Delta | −8.4% | −30.1% | −12.3% | −9.3% | −12.8% |

The following Printer set-up was used:

Printer:

Epson Stylus Photo 870

Printer Settings:

Print quality—photo 1440 dpi

Premium Glossy Photo Paper

The data in table 2 show that for the colours measured, the light stability of an image printed onto the foamed polymer medium is as good as that achieved from the PVA control and also shows a significant improvement over the light stability exhibited by a commercially available porous medium (Epson Glossy Photo Paper).

The ozone stability of the respective media were then assessed by printing an image, measuring the densities of the various colours (choosing a patch that has the density closest to 1.0) and then subjecting it to ozone (1 ppm) for a period of 24 hours. The same colour patches were then measured again at the end of the 24 hour period and the loss of density calculated.

The ozone stability data are shown in table 3.

TABLE 3

| Ozone stability data | | | | |
|---|---|---|---|---|
| Ctg | | Cyan | Magenta | Black |
| Foamed | Fresh | 1.021 | 0.916 | 0.921 |
| Polymer | After 24 Hrs | 1.085 | 0.909 | 0.958 |
| Medium | Delta | +6.3% | −0.8% | +4.0% |
| PVA | Fresh | 0.986 | 1.018 | 1.057 |
| Control | After 24 Hrs | 0.953 | 1.022 | 1.053 |
| | Delta | −3.4% | +0.4% | −0.4% |
| Epson | Fresh | 0.931 | 1.082 | 0.811 |
| Glossy | After 24 Hrs | 0.653 | 0.411 | 0.496 |
| Photo | Delta | −29.9% | −62.0% | −38.8% |

In this case, the following printer set up was used:

Printer:
Kodak PPM 200

Printer Settings:
Print quality—high resolution (1200×1200 dpi)
Kodak Premium Paper The data in table 3 show that for the colours measured, the ozone stability of an image printed onto the foamed polymer medium is as good as that achieved from the PVA control. The data also show a significant improvement over the ozone stability for the medium of the present invention over that exhibited by a commercially available porous medium (Epson Glossy Photo Paper).

From this example, it can be seen that by using a foamed (and therefore voided) polymer layer as an inkjet medium, improved drytime can be achieved compared to a non-porous PVA layer. It can also be seen that the image stability from this type of medium is comparable to that of a non-porous medium and shows significant improvement in image stability over a traditional porous medium, such as the Epson Glossy Photo Paper.

The invention claimed is:

1. An inkjet recording medium consisting essentially of:

a support; and one or more porous hydrophilic polymer ink receiving layer(s) supported on said support, said one or more porous hydrophilic polymer ink receiving layer(s) consisting essentially of a porous foamed hydrophilic polymer in which the hydrophilic polymer is swellable, decomposition product of a blowing agent, and, optionally, a surfactant, wherein the porous foamed hydrophilic polymer is formed by the decomposition of a blowing agent in a layer coated from a solution of said swellable hydrophilic polymer, wherein the one or more porous hydrophilic polymer ink receiving layer(s) are capable of absorbing dye from an applied ink within the polymer.

2. A medium according to claim 1, in which the porous foamed hydrophilic polymer includes at least one polymer selected from the group consisting of polyvinyl alcohol, polyethylene oxide, polyvinyl pyrrolidone and gelatin.

3. A medium according to claim 1, in which the support is made of a material selected from the group consisting of resin-coated paper, PET, acetate and printing plate.

4. A medium according to claim 1, which includes a fluorosurfactant.

5. A medium according to claim 1, in which the proportion by weight of a surfactant to coating solution used in the preparation of the medium is in an amount from about 0.01% to about 2.0%.

6. A medium according to claim 1, in which the proportion by weight of blowing agent used in the preparation of said medium to hydrophilic polymer is up to about 200%.

7. A medium according to claim 6, in which the proportion by weight of blowing agent used in the preparation of said medium to hydrophilic polymer is in an amount from about 10% to about 60%.

8. A medium according to claim 1, which comprises a plurality of said porous hydrophilic polymer ink receiving layers.

9. An inkjet recording medium according to claim 1, wherein the ink receiving layers of said inkjet recording medium consist of said one or more porous hydrophilic polymer ink receiving layers.

10. A porous inkjet recording medium consisting essentially of:

a support; and one or more porous ink receiving layers, supported on said support, consisting essentially of a porous foamed hydrophilic polymer which hydrophilic polymer is swellable, decomposition product of a blowing agent, and optionally a surfactant, wherein the porous foamed hydrophilic polymer is formed by the decomposition of a blowing agent in a layer coated from a solution of said swellable hydrophilic polymer, wherein the one or more porous ink receiving layer(s) are capable of absorbing dye from an applied ink within the polymer, differing from other porous inkjet recording media in which dye is held in pores located between particles.

11. A medium according to claim 10, which comprises a plurality of said porous ink receiving layers.

12. An inkjet recording medium according to claim 10, wherein the ink receiving layers of said inkjet recording medium consist of said one or more porous ink receiving layers.

13. An inkjet recording medium consisting essentially of:

a support; and one or more porous hydrophilic polymer ink receiving layer(s) supported on said support, said one or more porous hydrophilic polymer ink receiving layer(s) consisting essentially of a porous foamed hydrophilic polymer in which the hydrophilic polymer is swellable, decomposition product of a blowing agent, and, optionally, either a crosslinker or a crosslinker and a surfactant, wherein the porous foamed hydrophilic polymer is formed by the decomposition of a blowing agent in a layer coated from a solution of said swellable hydrophilic polymer, wherein the one or more porous hydrophilic polymer ink receiving layer(s) are capable of absorbing dye from an applied ink within the polymer.

* * * * *